United States Patent [19]

Tabak

[11] 4,433,185

[45] Feb. 21, 1984

[54] TWO STAGE SYSTEM FOR CATALYTIC CONVERSION OF OLEFINS WITH DISTILLATE AND GASOLINE MODES

[75] Inventor: Samuel A. Tabak, Wenonah, N.J.

[73] Assignee: Mobil Oil Corporation, New York, N.Y.

[21] Appl. No.: 481,705

[22] Filed: Apr. 4, 1983

[51] Int. Cl.[3] ..... C07C 3/00; C07C 3/03; C07C 3/10; C07C 3/62

[52] U.S. Cl. ..... 585/312; 585/315; 585/322; 585/329; 585/412; 585/415; 585/469; 585/733

[58] Field of Search ..... 585/415, 412, 413, 424, 585/423, 422, 469, 315, 311, 314, 322, 329, 312

[56] References Cited

U.S. PATENT DOCUMENTS

| | | | |
|---|---|---|---|
| 3,760,024 | 9/1973 | Cattanach | 585/415 |
| 3,827,968 | 1/1973 | Givens et al. | 585/322 |
| 4,211,640 | 7/1980 | Garwood et al. | 208/255 |
| 4,227,992 | 10/1980 | Garwood et al. | 585/650 |

*Primary Examiner*—Delbert E. Gantz
*Assistant Examiner*—A. Pal
*Attorney, Agent, or Firm*—Alexander J. McKillop; Charles J. Speciale; L. G. Wise

[57] ABSTRACT

An improved process for converting an olefinic feedstock containing ethene and $C_3$+ alkenes to produce a heavy hydrocarbon product rich in distillate by contacting the feedstock with an oligomerization catalyst bed, at elevated pressure and temperature conditions in operating mode favorable to formation of heavy distillate product by selective conversion of $C_3$+ alkenes. The improvement comprises providing a distillate mode effluent stream containing substantially unconverted ethene in vapor phase and condensed distillate, and recovering unconverted ethene-rich hydrocarbon vapor from the distillate mode effluent stream and further converting such to olefinic gasoline in a second oligomerization catalyst bed at reduced moderate pressure and elevated temperature conditions in operating mode favorable to formation of $C_6$+ olefinic gasoline. At least a portion of the olefinic gasoline is recycled for conversion with the feedstock in the distillate mode catalyst bed. Gasoline and distillate mode effluent streams may be fractionated to recover a light hydrocarbon stream rich in $C_3$+ aliphatic hydrocarbons for recycling at least a portion of the light hydrocarbon stream to dilute the ethene-rich vapor in the second gasoline mode catalyst bed.

10 Claims, 4 Drawing Figures

TWO STAGE SYSTEM FOR CATALYTIC CONVERSION OF OLEFINS WITH DISTILLATE AND GASOLINE MODES

FIELD OF INVENTION

This invention relates to processes and apparatus for the manufacture of gasoline and/or distillate range hydrocarbon fuels. In particular it provides a technique for operating an integrated two-stage MOGD type plant wherein a crystalline zeolite oligomerization catalyst is employed for converting olefinic feedstocks containing $C_2$–$C_6$ alkenes at elevated temperature and pressure.

BACKGROUND OF THE INVENTION

In the process for catalytic conversion of olefins to heavier hydrocarbons by catalytic oligomerization using an acid crystalline zeolite, such as ZSM-5 type catalyst, process conditions can be varied to favor the formation of either gasoline or distillate range products. At moderate temperature and relatively high pressure, the conversion conditions favor distillate range product having a normal boiling point of at least 165° C. (330° F.). Lower olefinic feedstocks containing $C_2$–$C_6$ alkenes may be converted selectively; however, the distillate mode conditions do not convert a major fraction of ethylene. While propene, butene-1 and others may be converted to the extent of 50 to 95% in the distillate mode, only about 10 to 20% of the ethylene component will be consumed.

In the gasoline mode, ethylene and the other lower olefins are catalytically oligomerized at higher temperature and moderate pressure. Under these conditions ethylene conversion rate is greatly increased and lower olefin oligomerization is nearly complete to produce an olefinic gasoline comprising hexene, heptene, octene and other $C_6$+ hydrocarbons in good yield. To avoid excessive temperatures in the exothermic reactors, the lower olefinic feed may be diluted. In the distillate mode operation, olefinic gasoline may be recycled and further oligomerized, as disclosed in U.S. Pat. No. 4,211,640 (Garwood and Lee). In either mode, the diluent may contain light hydrocarbons, such as $C_3$–$C_4$ alkanes, present in the feedstock and/or recycled from the debutanized product.

SUMMARY

A novel technique has been found for two-stage olefin conversion employing a first distillate mode reactor zone and a second gasoline mode reactor zone. Advantageously, the pressure differential between the two stages can be utilized in an intermediate flashing separation step. Unreacted ethylene and other light gases are readily recovered from heavier hydrocarbons in the flashed liquid phase.

Accordingly, it is an object of this invention to provide a continuous system for converting an olefinic feedstock containing ethylene and $C_3$+ olefins by catalytic oligomerization to produce heavier hydrocarbons in the gasoline or distillate boiling range which comprises method and means for (a) contacting the olefinic feedstock in a first catalyst reactor zone with a crystalline zeolite oligomerization catalyst at elevated pressure and moderate temperature under conditions favorable for conversion of $C_3$+ olefins to a first reactor effluent stream rich in distillate range hydrocarbons;

(b) flashing the distillate-rich stream and separating the first reactor effluent stream into a liquid stream rich in distillate and a vapor stream rich in ethylene, and (c) contacting the ethylene-rich stream from step (b) in a second catalyst reactor zone with a crystalline zeolite oligomerization catalyst at moderate pressure and elevated temperature under conditions favorable for conversion of ethylene and other lower olefins to a second reactor effluent stream rich in gasoline range hydrocarbons.

Advantageously, the reactor effluent is fractionated to provide a $C_3$–$C_4$ rich stream for recycle to the second reactor zone and a gasoline stream for recycle to the first reactor zone. In the preferred embodiments, an acid ZSM-5 type catalyst is employed.

THE DRAWINGS

DESCRIPTION OF THE PREFERRED EMBODIMENTS

Conversion of olefins to gasoline and/or distillate products is disclosed, for example, in U.S. Pat. Nos. 3,960,978 and 4,021,502 (Givens, Plank and Rosinski) wherein gaseous olefins in the range of ethylene to pentene, either alone or in admixture with paraffins are converted into an olefinic gasoline blending stock by contacting the olefins with a catalyst bed made up of a ZSM-5 type zeolite. In U.S. Pat. No. 4,227,992 Garwood and Lee disclose the operating conditions for the Mobil Olefin to Gasoline Distillate (MOGD) process for selective conversion of $C_3$+ olefins and only 20% maximum ethene ($C_2$−−) conversion. In a related manner, U.S. Pat. No. 4,150,062 (Garwood et al.) discloses a process for converting olefins to gasoline components. Typically, the process recycles cooled gas or liquid $C_3$–$C_4$ alkanes from a high-temperature, high-pressure separator downstream of the catalyst bed back into the reaction zone where additional olefins are converted to gasoline and distillate products. If the reaction of the olefins in converting them to distillate and gasoline is allowed to progress in the catalyst stream without any measure taken to prevent the accumulation of heat, the reaction becomes so exothermically accelerated as to result in high temperatures and the production of undesired products.

Figure 1:
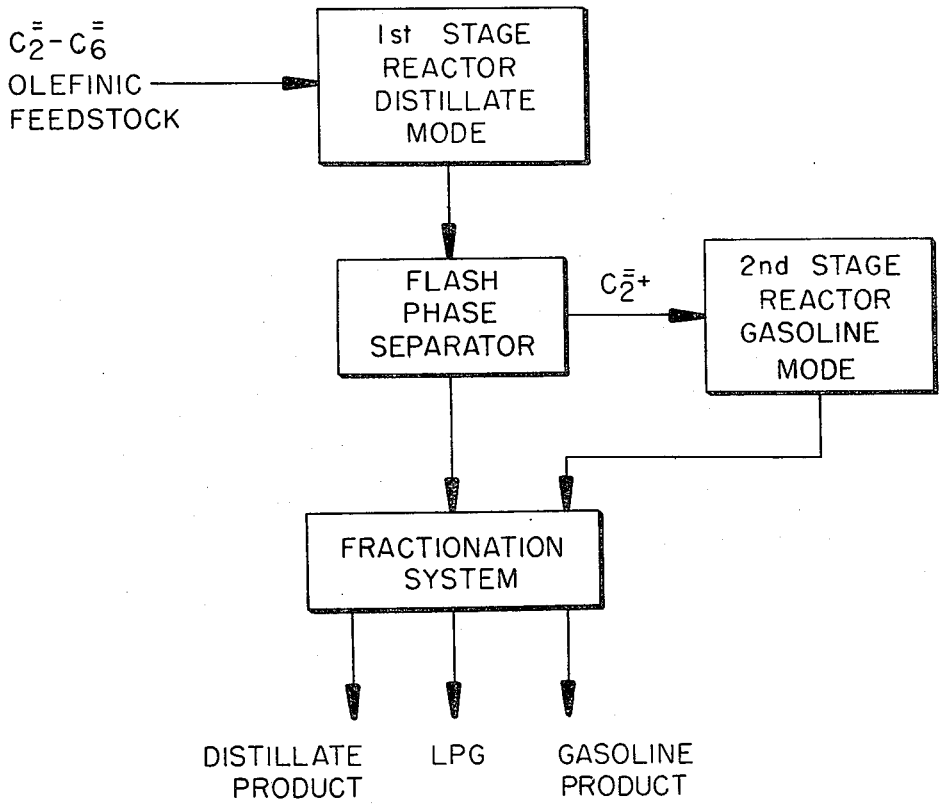
FIG. 1 is a process flow sheet showing the major unit operations and hydrocarbon streams.

In FIG. 1 the conceptual system design is shown in block process flow diagram form, with the olefinic feedstock comprising ethene together with propene, butene, pentene, and/or hexene, is passed to the first stage reactor system operating at high pressure in a mode to maximize formation of distillate. The first stage effluent is cooled and reduced in pressure by flashing into a phase separation zone to provide an ethene-rich vapor phase and a liquid stream rich in heavier hydrocarbons. This separation unit may be operated to advantage by recovering a major amount of $C_6$+ hydrocarbons in the liquid phase and passing the unconverted $C_2$–$C_5$ aliphatic gases to the second stage. The unreacted ethene and other light gases are then catalytically reacted at elevated temperature and moderate pressure to form additional $C_6$+ hydrocarbons rich in olefinic gasoline. Effluent from each reactor stage may be fractionated separately or combined in an integrated fractionation system as shown to recover the desired products. A portion of the $C_3$–$C_4$ alkanes (LPG) may be recycled to dilute the $C_2$−− rich second stage feedstream and gasoline containing $C_6$+ olefins may be recycled to the first stage to dilute the feedstock. This system is adapted for integrating two MOGD type reactors operating at different reaction conditions to first maximize distillate yield and then cascading unreacted lower olefins to a higher temperature for complete conversion to gasoline.

The oligomerization catalysts preferred for use herein include the crystalline aluminosilicate zeolites having a silica to alumina ratio of at least 12, a constraint index of about 1 to 12 and acid cracking activity of about 160–200. Representative of the ZSM-5 type zeolites are ZSM-5, ZSM-11, ZSM-12, ZSM-23, ZSM-35 and ZSM-38. ZSM-5 is disclosed and claimed in U.S. Pat. No. 3,702,886 and U.S. Pat. No. Re. 29,948; ZSM-11 is disclosed and claimed in U.S. Pat. No. 3,709,979. Also, see U.S. Pat. No. 3,832,449 for ZSM-12; U.S. Pat. No. 4,076,842 for ZSM-23; U.S. Pat. No. 4,016,245 for ZSM-35 and U.S. Pat. No. 4,046,839 for ZSM-38. The disclosures of these patents are incorporated herein by reference. A suitable catalyst for fixed bed is a HZSM-5 zeolite with alumina binder in the form of cylindrical extrudates of about 1–5 mm.

In order to take advantage of the inventive concept, the preferred feedstock to be changed to the first stage of the integrated system should contain at least 5 mole % ethylene, preferably 10 to 50%, and substantially no hydrogen. A typical olefinic feedstock contains a major fraction (50+ mole %) of combined $C_2$–$C_4$ alkenes with minor amounts of $C_5$+ alkenes. Other volatile hydrocarbons such as low molecular weight paraffins are often found in petroleum refinery streams, such as catalytic cracker by-product depropanizer off-gas. It is an object of the present invention to upgrade lower olefinic hydrocarbons to more valuable liquid fuel products or the like.

Figure 2:
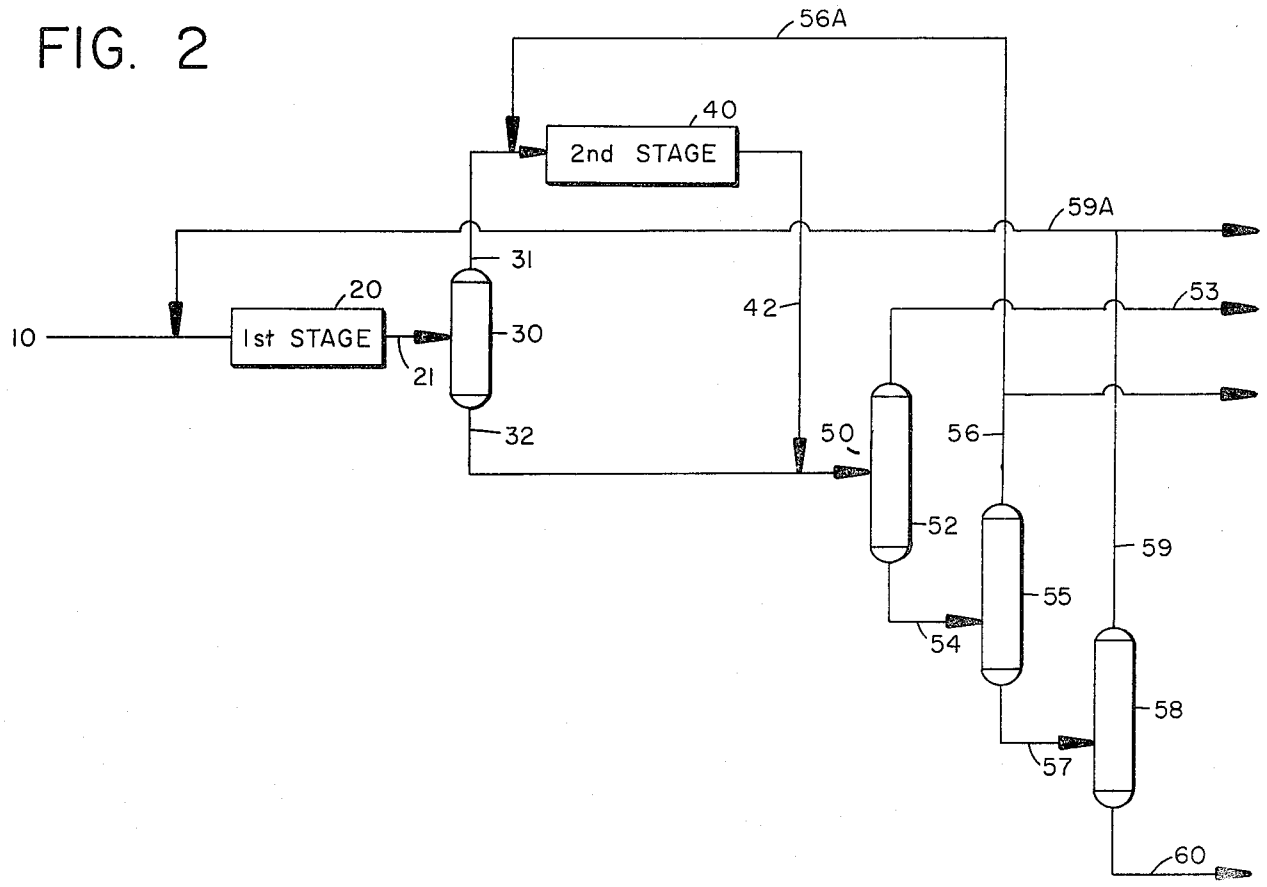
FIG. 2 is a schematic representation of a preferred two stage reactor system and a multi-tower fractionation system.

Referring to the drawing of FIG. 2, the flow sheet shows a preferred process wherein the total olefinic feedstock 10 is charged to a maximum distillate mode first stage unit 20. Here the $C_3$+ olefins are converted to primarily distillate, while $C_2$−− reaction is low, on the order of 10 to 20%. The reactor effluent is then flashed in separator 30 to give a pressurized vapor phase (primarily $C_5$ and lower), which is cascaded at a lower pressure to a gasoline mode second stage unit 40. High temperature olefin conversion approaches 100% on reaction to olefinic gasoline with some distillate in the absence of added hydrogen. Both reactor effluents are combined and sent to a common fractionation system 50.

A series of distillation towers include deethanizer column 52, from which $C_1$–$C_2$ off-gas is withdrawn as overhead vapor stream 53. Heavier components in bottoms streams 54 are further fractionated in debutanizer column 55 to provide $C_3$–$C_4$ overhead stream 56. This stream may be recovered at LPG product and/or recycled to the gasoline mode 40 reactor to help control heat of reaction. Debutanizer bottoms stream 57 is further fractionated in splitter column 58 to provide $C_5$+ overhead vapor stream 59 rich in hexenes, octenes or the like. This olefinic gasoline product is recycled to the distillate reactor to help control heat of reaction and further react to distillate, or recovered as usable product. Fractionator bottoms stream 60 consisting essentially of distillate range hydrocarbons boiling above about 165° C. may be used as fuel oil or hydrotreated in known manner to improve its cetane number. Using the combined effluent fractionation system any light distillate produced in the gasoline reactor is recovered as distillate.

Figure 3:
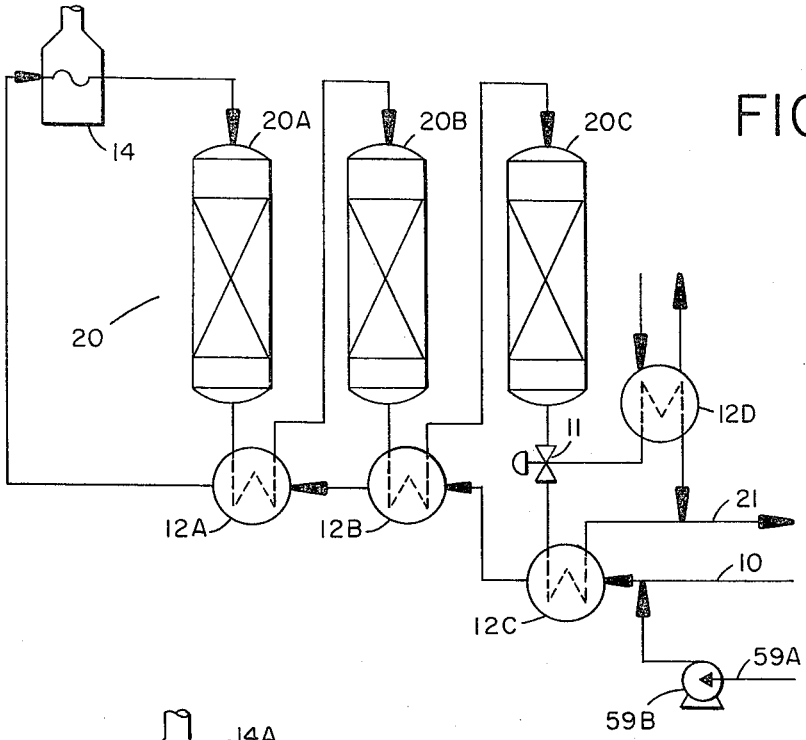
FIG. 3 is a typical olefin conversion reactor system for first stage distillate mode operation.

A typical distillate mode first stage reactor system 20 is shown in FIG. 3. A multi-reactor system is employed with inter-zone cooling, whereby the reaction exotherm can be carefully controlled to prevent excessive temperature above the normal moderate range of about 190° to 315° (375°–600° F.). $C_2$–$C_6$ olefinic feedstock is introduced through conduit 10 and carried by a series of conduits through heat exchangers 12A, B, C and furnace 14 where the feedstock is heated to reaction temperature. The olefinic feedstock is then carried sequentially through a series of zeolite beds 20A, B, C wherein at least a portion of the olefin content is converted to heavier distillate constituents. Advantageously, the maximum temperature differential across only one reactor is about 30° C. ($\Delta T \sim 50°$ F.) and the space velocity (LHSV based on olefin feed) is about 0.5 to 1.5. The heat exchangers 12A and 12B provide inter-reactor cooling and 12C reduces the effluent to flashing temperature. An optional heat exchanger 12D may further recover heat from the effluent stream 21 prior to phase separation. Gasoline from recycle conduit 59A is pressurized by pump means 59B and combined with feedstock, preferably at a ratio of about 1–3 parts by weight per part of olefin in the feedstock.

Between stages it is preferred to take advantage of a significant pressure drop by flashing the effluent with a pressure differential of at least 1400 kPa (200 psi) between the first stage and phase separator vessel 30. By operating the first stage at elevated pressure of about 4200 to 7000 kPa (600–1000 psig), this can be achieved. Any suitable enclosed pressure vessel can be used as the separator unit, which is operatively connected by conduits 21, 31, 32 in fluid flow relationship to the two stages and fractionation system.

Figure 4:
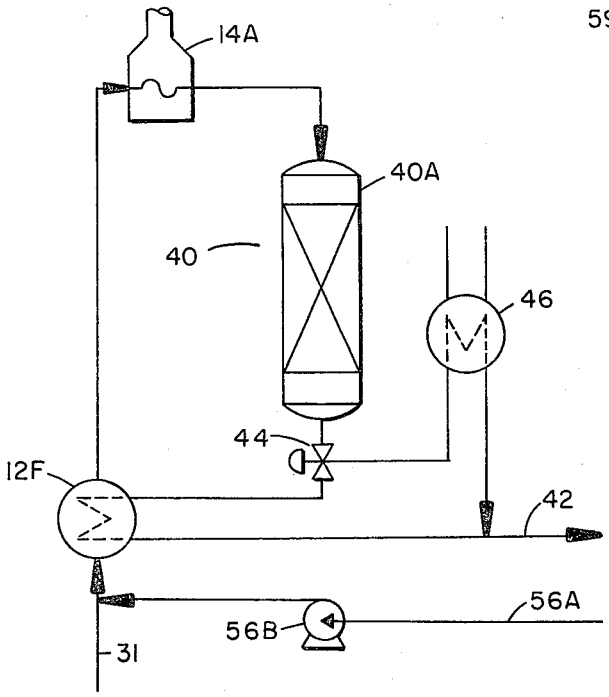
FIG. 4 is a typical second stage reactor system for gasoline mode operation.

The gasoline mode reactor 40 shown in FIG. 4, is relatively simple, since the higher temperature conversion does not require maximum differential temperature control closer than about 65° C. ($\Delta T \sim 120°$ F.) in the approximate elevated range of 285° C. to 375° C. (550°–700° F.). The reactor bed 40A is maintained at a moderate super atmospheric pressure of about 400 to 3000 kPa (50–400 psig) and the space velocity for ZSM-5 catalyst to optimize gasoline production should be about 0.5 to 3 (LHSV). Preferably, all of the catalyst reactor zones in the system comprise a fixed bed down flow pressurized reactor having a porous bed of ZSM-5 type catalyst particles with an acid activity of about 160 to 200.

The overall pressure drop across the system is at least 1500 kPa and it is advantageous to take most of this pressure drop prior to entering the flashing vessel 30, such that the flashing vessel is maintained at a pressure only high enough to allow overhead vapor to cascade into the gasoline mode reactor 40. Unconverted ethylene and other light gases are passed from the separator through conduit 31, heat exchanger 12F, and furnace 14A to gasoline mode reactor bed 40A. Since this reactor operates at a high differential temperature ($\Delta T \sim 120°$ F.) the furnace need not be used in normal operation and can be bypassed, with all feed preheat coming from exchanger 12F. The second stage effluent is cooled partially in exchanger 12F and passed through conduit 42 to the fractionation system 50. Optionally, a portion of the hot effluent may be diverted by valve 44 through heat recovery exchanger 46. $C_3$–$C_4$ alkanes of other diluents may be introduced through recycle conduit 56A and pump 56B.

Various modifications can be made to the system, especially in the choice of equipment and non-critical processing steps. While the invention has been described by specific examples, there is no intent to limit the inventive concept as set forth in the following claims.

What is claimed is:

1. A continuous process for converting an olefinic feedstock containing ethylene and $C_3$+ olefins by catalytic oligomerization to produce heavier hydrocarbons in the gasoline or distillate boiling range which comprises:

(a) contacting the olefinic feedstock in a first catalyst reactor zone with a crystalline zeolite oligomerization catalyst at elevated pressure and moderate temperature under conditions favorable for conversion of $C_3$+ olefins to a first reactor effluent stream rich in distillate range hydrocarbons;

(b) flashing the distillate-rich stream and separating the first reactor effluent stream into a liquid stream rich in distillate and a vapor stream rich in ethylene;

(c) contacting the ethylene-rich stream from step (b) in a second catalyst reactor zone with a crystalline zeolite oligomerization catalyst at moderate pressure and elevated temperature under conditions favorable for conversion of ethylene and other lower olefins to a second reactor effluent stream rich in olefinic gasoline range hydrocarbons;

(d) reactionating effluent from the second reactor zone to recover a gasoline stream; and (e) recycling at least a portion of the gasoline stream to the first reactor zone.

2. The process of claim 1 wherein reactor effluent is fractionated to provide a $C_3$–$C_4$ rich stream for recycle to the second reactor zone.

3. The process of claim 1 wherein the first and second reactor zones contain an acid ZSM-5 type catalyst.

4. The process of claim 3 wherein the catalyst reactor zones comprise a fixed bed down flow pressurized reactor having a porous bed of ZSM-5 type catalyst particles with an acid activity of about 160 to 200.

5. The process of claim 4 wherein the first reactor zone is maintained at a pressure of about 4200 to 7000 kPa and a temperature of about 190° C. to 315° C.; and wherein the second reactor zone is maintained at a pressure of about 400 to 3000 kPa and a temperature of about 285° C. to 375° C.

6. The process of claim 1 wherein first zone liquid effluent containing olefinic gasoline and distillate hydrocarbons and second zone effluent containing olefinic gasoline are combined and fractionated to recover an olefinic gasoline stream and a distillate product stream.

7. In the process for converting an olefinic feedstock containing ethene and $C_3$+ alkenes to produce a heavy hydrocarbon product rich in distillate by contacting the feedstock with an oligomerization catalyst bed, at elevated pressure and temperature conditions in operating mode favorable to formation of heavy distillate product by selective conversion of $C_3$+ alkenes, the improvement which comprises:

providing a distillate mode effluent stream containing substantially unconverted ethene in vapor phase and condensed distillate;

recovering unconverted ethene-rich hydrocarbon vapor from the distillate mode effluent stream and further converting such to olefinic gasoline in a second oligomerization catalyst bed at reduced moderate pressure and elevated temperature conditions in operating mode favorable to formation of $C_6$+ olefinic gasoline; and recycling at least a portion of the olefinic gasoline for conversion with the feedstock in the distillate mode catalyst bed.

8. The process for claim 7 including the further steps of fractionating gasoline and distillate mode effluent streams to recover a light hydrocarbon stream rich in $C_3$+ aliphatic hydrocarbons and recycling at least a portion of the light hydrocarbon stream to dilute the ethene-rich vapor in the second gasoline mode catalyst bed.

9. The process of claim 7 wherein the distillate mode catalyst and gasoline mode catalyst comprise crystalline HZSM-5 and wherein olefins and converted in the substantial absence of added hydrogen.

10. The process of claim 7 wherein the distillate mode effluent stream is flashed by a pressure reduction of at least 1400 kPa prior to phase separation.

* * * * *